United States Patent [19]

Arakaki

[11] 4,079,940

[45] Mar. 21, 1978

[54] GOLF SHOT ALIGNMENT DEVICE

[76] Inventor: Glen S. Arakaki, 1840 Makuahine Pl., Honolulu, Hi. 96817

[21] Appl. No.: 722,830

[22] Filed: Sep. 13, 1976

[51] Int. Cl.[2] ..... A63B 69/36

[52] U.S. Cl. ..... 273/183 B; 273/183 E; 2/185 R; 2/199

[58] Field of Search ..... 273/183 B, 183 E, 163 A, 273/163 R, 190 A, 194 R, 194 A; 46/178; 2/185 R, 199

[56] References Cited

U.S. PATENT DOCUMENTS

| | | | |
|---|---|---|---|
| 739,098 | 9/1903 | Messenger | 2/185 R |
| 3,362,023 | 1/1968 | McMahon | 273/183 B |
| 3,424,462 | 1/1969 | Driscoll | 273/194 X |
| 3,437,339 | 4/1969 | Starck | 273/183 B |

*Primary Examiner*—George J. Marlo
*Attorney, Agent, or Firm*—William B. Walter

[57] ABSTRACT

In order to insure uniform address of the ball for the golfer, a golf shot aligner with clips which fasten the aligner to the golfer's cap and comprised of a small adjustable length telescopic strut with a target on the outer end of the strut is provided which can be placed in line with the golfer's eyes and the golf ball for driving and locked in place for consistent shots with the same club.

1 Claim, 9 Drawing Figures

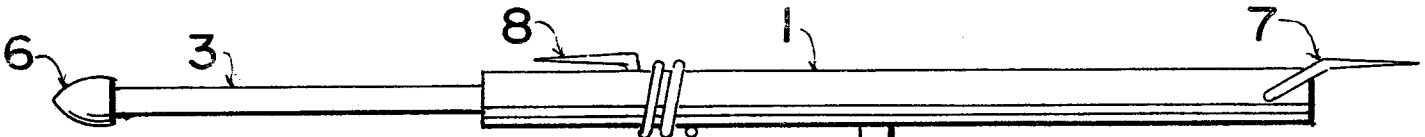
FIG. 4
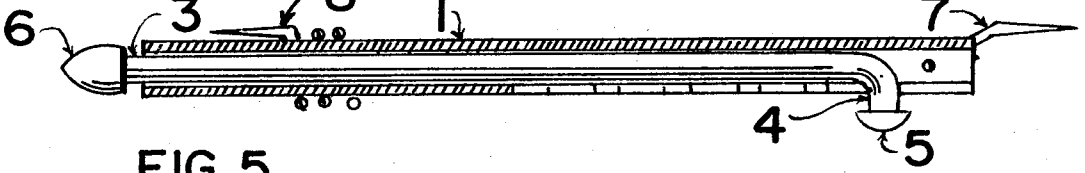
FIG. 5
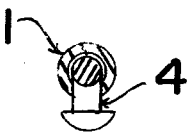
FIG. 6
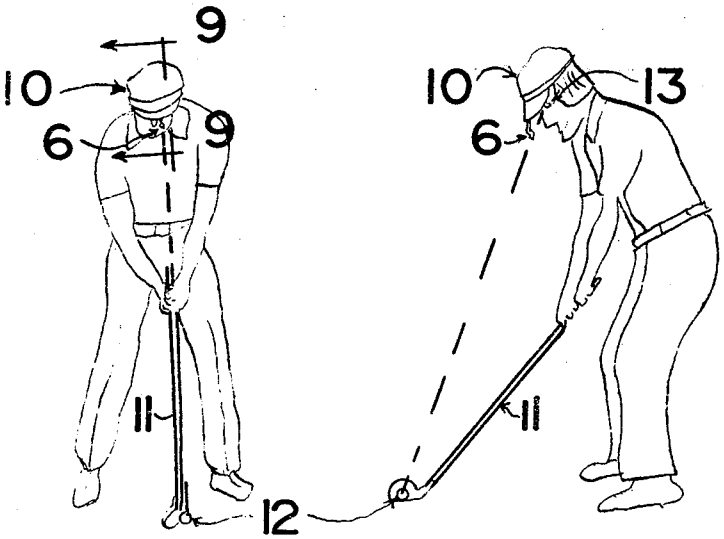
FIG. 7
FIG. 8
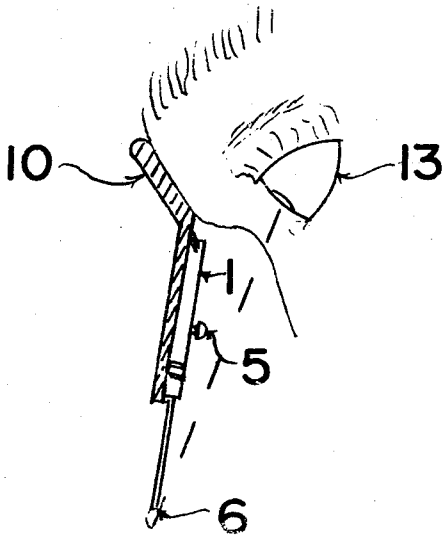
FIG. 9

GOLF SHOT ALIGNMENT DEVICE

BACKGROUND OF THE INVENTION

In order to increase his proficiency, the individual golfer has found throughout the years that his stance and address to the ball is an important factor. In a study of the prior art, it has been found that some inventors have used a pendulum type of head movement indicator suspended from a cap to warn the golfer that he has moved his head and possibly taken his eyes off the ball during the drive. Examples are found in U.S. Pat. Nos. 3,178,187 to Cardwell and 3,437,339 to Starck. Others have found that a sight rod or circular target attached to the golfer's cap or eyeglasses can be used to help the golfer to keep his head still during the swing. Examples of such a sighting device are found in U.S. Pats. 1,169,188 to Peck, 3,729,199 to Granberg and 3,826,502 to Sorge. Each of these sighting devices is readily adjusted for the individual swing.

SUMMARY OF THE INVENTION

It is a primary object of this invention to assist a golfer to place his head, body, arms and club in the same position with respect to the ball each time the stroke is executed so that the shot produced will be consistent. It is also an object of this invention to remind the golfer to keep his head down, keep his arms straight, align his feet properly and avoid excessive swaying.

Another important object of this invention is to provide an alignment device for the golfer such that it can be adjusted to a setting for the type of club, and the individual golfer and be locked in place.

This invention is a small telescopic strut consisting of a tube with hooks to secure it to the brim of a golfer's hat or cap and a target-tipped rod which slides in and out of the tube, with the rod having a knob on the other end projecting out through a longitudinal slot in the tube for adjustment of the target position.

BRIEF DESCRIPTION OF THE DRAWINGS

In the drawings.

FIG. 4 is a side view of the device of FIG. 1 with the target fully extended.

FIG. 5 is a sectional view of the alignment device along the line 5—5 of FIG. 1.

FIG. 6 is a sectional view of the alignment device along the line 6—6 of FIG. 2.

FIG. 7 is a front elevation of a golfer using the alignment device.

FIG. 8 is a side elevation of the golfer of FIG. 7 using the alignment device.

FIG. 9 is an enlarged side view of a portion of the head of the golfer, with the golfer's cap in cross-section along the line 9—9 of FIG. 7.

DETAILED DESCRIPTION OF THE INVENTION

Figure 1:
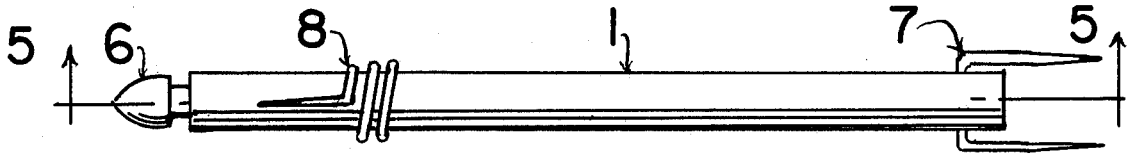
FIG. 1 is a plan view of a preferred form of the alignment device with the target retracted.
Figure 2:
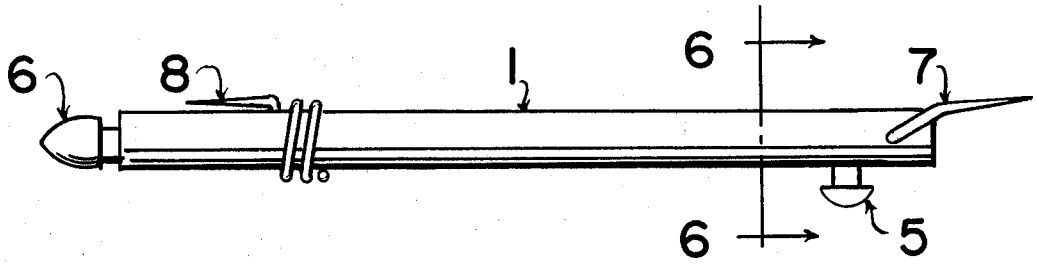
FIG. 2 is a side view of the alignment device of FIG. 1 with the target retracted.

Referring to the drawings, an alignment device to assist the golfer is a telescopic member, in a preferred embodiment, comprised of a fixed end in the form of a tube 1 having a longitudinal slot 2 throughout a portion of its length and a movable end in the form of a bar 3 having a transverse portion 4 which protrudes out through the slot 2. A knob 5 on the end of the transverse portion 4 facilitates moving of the bar 3 in and out of the tube 1 to adjust the length of the telescopic member. A target 6 is secured to the terminal end of bar 3.

A pointed "U" shaped pin 7 is inserted through a transverse hole in the tube 1 to secure it to the tube 1 and to serve as a keeper for the bar 3. A second pointed pin 8 is in the form of a helix wrapped around the tube 1 for a sliding attachment thereto.

In use, the alignment device is preferably secured to the underside of the brim of a golfer's cap 10 with pins 7 and 8 as shown in FIGS. 7, 8 and 9. When the golfer's feet, head, body, arms and the club 11 are in the desired position in relation to the ball 12 as seen in FIGS. 7 and 8 for the back-swing, fore-swing and striking the ball 12, the target 6 of the alignment device can be moved with knob 5 so as to align it with the line of sight from the golfer's eyes 13 to the ball 12.

Figure 3:
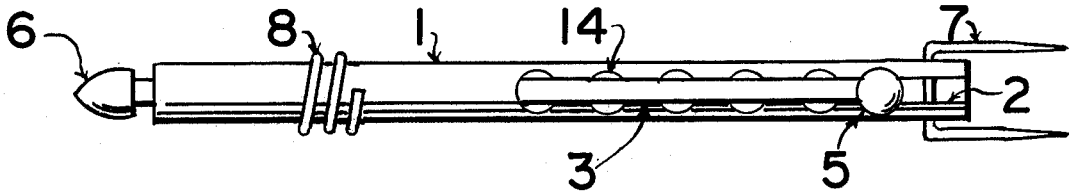
FIG. 3 is a bottom view of the alignment device of FIG. 1 and retracted as in FIGS. 2 and 3.

In the preferred embodiment as shown in FIG. 3, a series of notches 14 in the slot 2 and a tight fit between the slot 2 and the transverse portion 4 of the bar 3 serve to securely hold the target 6 at any one of a number of settings. When using the alignment device for a different type of shot with a different club, the golfer will set the target at a different point. He may then mark the desired setting for each type of club or shot on the alignment device for future reference.

I claim:

1. An alignment device to assist a golfer to place his feet, body, arms and a hand-held club in the same relative position to the ball for each stroke with that club and to help him to keep his eyes focused on the ball during the back-swing, fore-swing and striking of the ball comprising:

a. a tube having a longitudinal slot throughout part of its length;

b. a bar slidably mounted within said tube so that one end of the bar extends out from one end of the tube and having a transverse portion extending out through the slot in the tube, the bar and tube thus forming a telescopic member, the length of which can be varied by moving the transverse portion of the bar along the tube's slot;

c. a target operably secured to the outer end of the bar;

d. a golfer's hat having a brim;

e. a means operably attaching the tube to the brim of the golfer's cap so that the bar can be extended out from the golfer's forehead varying amounts, said means assuring a fixed relationship between the brim and the telescopic member and comprising a pair of pins operably secured to the tube so as to face in opposing directions with the axes of the pins being parallel to the tube; and f. means for holding the bar at a variety of positions of extension from the tube whereby when the cap is worn by the golfer, the target may be moved towards and away from the golfer's forehead to set the target in line between the golfer's eyes and the golf ball as placed on the ground or tee.

* * * * *